United States Patent [19]

Burak

[11] 4,434,808

[45] Mar. 6, 1984

[54] ANTI-SKID DEVICE FOR A CANE, CRUTCH, OR THE LIKE

[76] Inventor: Mark G. Burak, 6045 Fifth Ave. South, Minneapolis, Minn. 55419

[21] Appl. No.: 389,646

[22] Filed: Jun. 18, 1982

[51] Int. Cl.[3] ..... A45B 9/04; A61H 3/02

[52] U.S. Cl. ..... 135/80; 135/70

[58] Field of Search ..... 135/44, 65, 66, 70, 135/77, 78, 79, 80, 81

[56] References Cited

U.S. PATENT DOCUMENTS

| | | | |
|---|---|---|---|
| 970,497 | 9/1910 | Harding | 135/70 |
| 1,284,991 | 11/1918 | Beecroft | 135/80 |
| 1,304,978 | 5/1919 | Herrold | 135/80 X |
| 1,518,382 | 12/1924 | Beecroft | 135/80 |
| 2,371,246 | 3/1945 | McGrory et al. | 135/70 |
| 3,512,541 | 5/1970 | Goggins | 135/80 |
| 3,646,949 | 3/1972 | Streeter | 135/80 |
| 3,881,504 | 5/1975 | Pfaff | 135/70 |

FOREIGN PATENT DOCUMENTS

| | | | |
|---|---|---|---|
| 763234 | 7/1967 | Canada | 135/78 |

*Primary Examiner*—Robert A. Hafer

*Assistant Examiner*—Arnold W. Kramer

*Attorney, Agent, or Firm*—Wicks & Nemer

[57] ABSTRACT

An anti-skid device according to the teachings of the present invention is shown utilized with a cane, crutch, or the like and includes a gripping member having a plurality, preferably three, non-skid pins which are vertically adjustable therein. The gripping member is preferably vertically movable by and rotatable about a vertical pin which is parallel to and spaced from the crutch. For moving the gripping member from a biased, raised, non-engaged position to a lowered, engaged position, a pivot member is provided pivotally mounted to the crutch at a point intermediate its first and second ends. The first end of the pivot member engages with and pushes the vertical pin upon which the gripping member is mounted. An actuating handle located adjacent the handhold of the crutch is pivotally interrelated to the second end of the pivot member by a cable attached therebetween. A lever arm pivotally mounted to the crutch is attached to the cable intermediate the handle and the pivot member for increasing the cable travel distance by leverage principles.

13 Claims, 7 Drawing Figures

ANTI-SKID DEVICE FOR A CANE, CRUTCH, OR THE LIKE

SUMMARY AND BACKGROUND

The present invention relates generally to canes, crutches, and the like, relates specifically to improved canes, crutches, and the like for use on slippery types of travel surfaces, and relates more particularly to an anti-skid device for a cane, crutch, or the like.

As is well known in the art, canes, crutches, and the like are prone to skid or slip on slippery type travel surfaces, such as travel surfaces covered by ice or snow. Canes, crutches, and the like are especially prone to slipping under cold conditions where a rubber tip conventionally located on the bottom end of the cane, crutch, or the like becomes hard and loses its gripping characteristics due to the cold temperatures. Prior to the present invention, canes, crutches, and the like included various retractable grippers; however such prior devices were less than satisfactory for various reasons. First, such devices were very prone to build-up of travel surface residue such as ice and snow, thus at times rendering the devices inoperable. Further, such prior devices did not engage with the travel surface if the crutch was located at certain angles to the travel surface, thus rendering the devices ineffective in these positions. Likewise, many of these prior devices included only a single spike, which does not provide effective anti-skid characteristics. Furthermore, these prior devices were of complicated structures requiring specially made canes, crutches, or the like or required extensive modification to existing canes, crutches, or the like.

The present invention solves these and other problems and disadvantages of the prior art in canes, crutches, or the like by providing in the preferred embodiment an anti-skid device. A non-skid member is movably mounted between a first, non-travel surface engaging position and a second, travel surface engaging position and is allowed to rotate about a vertical axis which is generally parallel to but spaced from the cane. The non-skid member has a removed portion for receiving the bottom end of the cane and defines a first abutment portion and a second abutment portion located on opposite sides of the bottom end of the cane. The non-skid member is then rotatable about the vertical axis between a first position where the first abutment portion abuts with the bottom end of the cane and a second position wherein the second abutment portion abuts with the bottom end of the cane. The non-skid member further includes members for contacting the travel surface in a non-skid manner located generally on opposite sides of the bottom end of the cane. The non-skid member may be biased in one of the first or second positions. The anti-skid device further includes a member for moving the non-skid member against the bias of the biasing member to the other of its first and second positions.

It is then an object of the present invention to provide an improved cane, crutch, or the like for use on slippery travel surfaces.

It is also an object of the present invention to provide a novel anti-skid device for a cane, crutch, or the like.

It is further an object of the present invention to provide such novel anti-skid device which insures that the non-skid member contacts the travel surface even though the cane, crutch, or the like is at an angle to the travel surface.

It is further an object of the present invention to provide such novel anti-skid device which knocks off any travel surface residue such as snow or ice from the non-skid member.

It is further an object of the present invention to provide such novel anti-skid device which is of simple design and which can be easily attached and removed from a standard cane, crutch, or the like.

These and further objects and advantages of the present invention will become clearer in the light of the following detailed description of an illustrative embodiment of this invention described in connection with the drawings.

DESCRIPTION OF THE DRAWINGS

The illustrative embodiment may best be described by reference to the accompanying drawings where.

Figure 1:
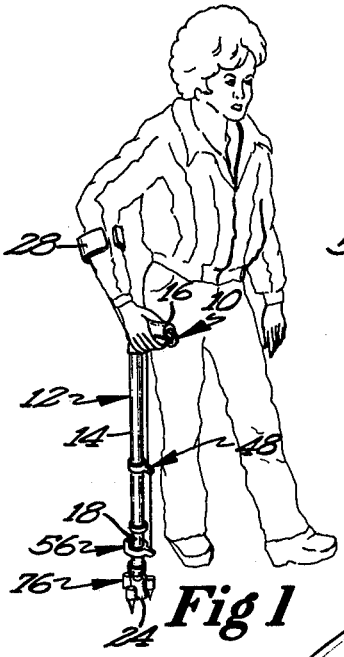
FIG. 1 shows a perspective view of a cane, crutch, or the like utilizing an anti-skid device according to the teachings of the present invention in use.
Figure 7:
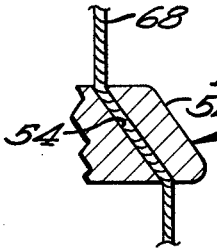
FIG. 7 shows a partial cross-sectional view of the anti-skid device of FIG. 1.

All figures are drawn for ease of explanation of the basic teachings of the present invention only; the extensions of the figures with respect to number, position, relationship, and dimensions of the parts to form the preferred embodiment will be explained.

Where used in the various figures of the drawings, the same numerals designate the same or similar parts in the various figures. Furthermore, when the terms "bottom", "first", "second", "vertical", "horizontal", and similar terms are used herein, it should be understood that these terms have reference only to the structure shown in the drawings as it would appear to a person viewing the drawings and are utilized only to facilitate describing the invention.

DESCRIPTION

In the drawings an anti-skid device according to the teachings of the present invention is designated 10 and shown attached to a standard cane or crutch 12. It should be understood that crutch 12 can be various constructions or shapes of a conventional or standard design or of specially constructed designs. Generally, crutch 12 includes a vertical member having a bottom end and a hand hold member and is utilized as an aid for walking.

In the preferred embodiment, crutch 12 generally includes a main tubular, support member 14, a hand hold member 16, a bottom extension 18 telescopically mounted in member 14 and held in position by a pin 20 which extends through a series of apertures 22 formed in member 14 and an aperture, not shown, formed in extension 18, a rubber tip 24 located on the bottom of extension 18, a top extension 26 telescopically mounted in member 14 and held in position by a pin 25 which extends through a series of apertures 27 formed in member 14 and an aperture, not shown, formed in top extension 26, and an arm brace 28. It should be appreciated that an advantage of device 10 according to the present invention is that it can be utilized with canes and crutches of various constructions, with crutch 12 as shown and described being particularly adaptable for use with device 10.

Figure 4:
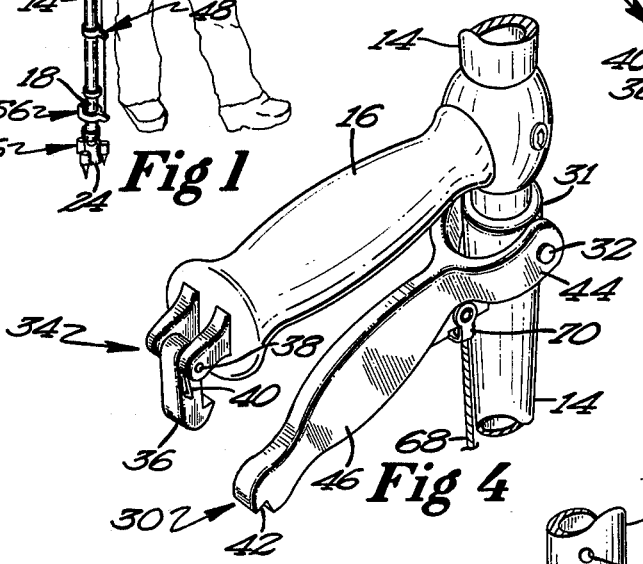
FIG. 4 shows a partial perspective view of the cane and anti-skid device of FIG. 1.
Figure 2:
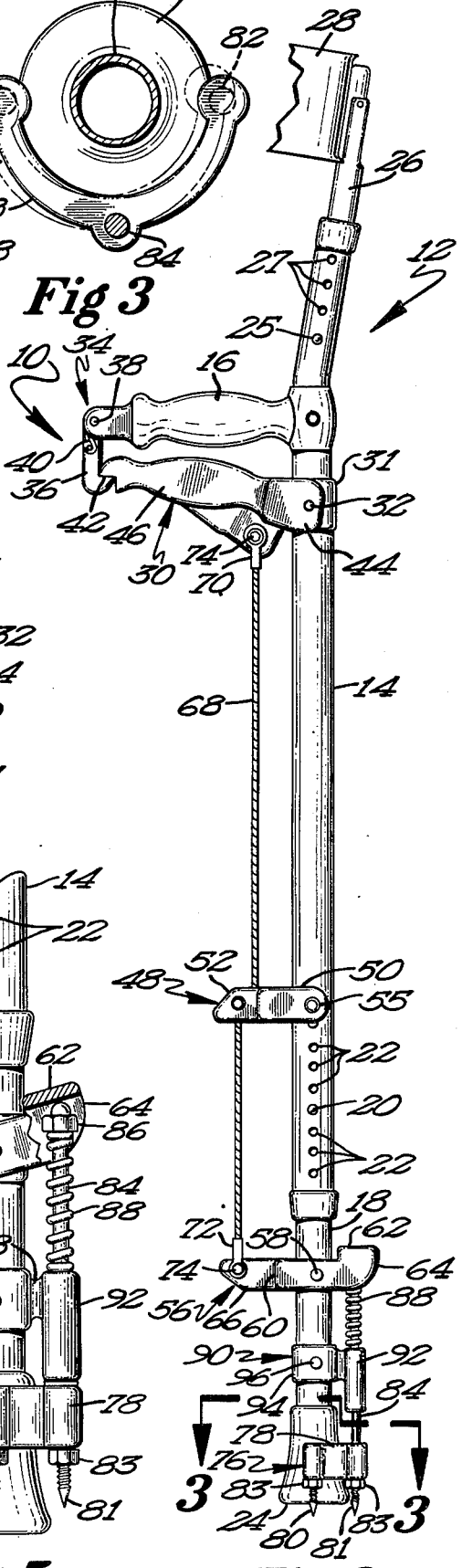
FIG. 2 shows a side plan view of the cane and anti-skid device of FIG. 1.
Figure 6:
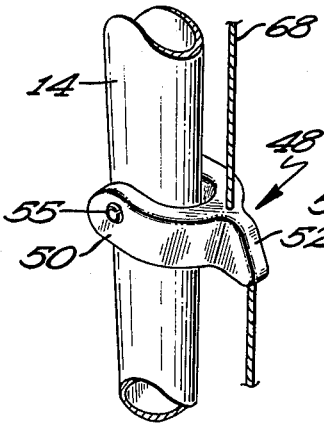
FIG. 6 shows a partial perspective view of the cane and anti-skid device of FIG. 1.

Device 10 in a preferred embodiment includes a handle 30 pivotally mounted to crutch 12 about a generally horizontal axis between a first, normal position as best seen in FIG. 4 and a second, engaged position as best seen in FIG. 2. Collar 31 is provided having a cross section and shape for receipt onto support member 14 of crutch 12 for pivotally mounting handle 30 to crutch 12. Set screws 32 are threadably received in collar 31 for abutting with support member 14 of crutch 12 for removably attaching collar 31 to crutch 12. In the preferred embodiment, screws 32 also pivotally mount handle 30. It should then be appreciated that handle 30 may be pivotally mounted to crutch 12 without requiring modification to crutch 12 such as drilling apertures therethrough which could structurally weaken crutch 12 or aesthetically change crutch 12 if device 10 is removed.

Device 10 further includes a member 34 for releasably holding handle 30 in its second, engaged position. Specifically, device 34 includes a hook member 36 pivotally mounted to hand hold member 16 of crutch 12 by pivot member 38. Spring 40 is provided for biasing hook member 36 towards handle 30. Handle 30 further includes a notch 42 having a shape complementary to and for engagement with hook member 36.

In the preferred form, handle 30 generally is Y-shaped and includes a U-shaped member 44 and an elongated handle portion 46 having a first end connected to the center portion of member 44 and extending in a direction opposite to the free ends of member 44. Notch 42 is formed in the second end of portion 46. Member 44 straddles member 14 of crutch 12 such that the free ends of member 44 are located on opposite sides of collar 31 and crutch 12 and screws 32 of collar 31 extend through the free ends of member 44.

The preferred form of device 10 shown further includes a lever arm 48 pivotally mounted about a generally horizontal axis to member 14 of crutch 12. In the preferred form, lever arm 48 is generally Y-shaped and includes a U-shaped member 50 and a lever portion 52 having a first end connected to the center portion of member 50 and extending in a direction opposite to the free ends of member 50. Member 50 straddles member 14 of crutch 12 such that the free ends of member 50 are located on opposite sides of crutch 12. A pin 55 extends between the free ends of member 50 through one of the apertures 22 of member 14 of crutch 12. Therefore, it is not necessary to have additional apertures formed in crutch 12. It should then be appreciated that lever arm 48 may be pivotally mounted to crutch 12 without requiring modification to crutch 12 such as drilling apertures therethrough which could structurally weaken crutch 12 or aesthetically change crutch 12 if device 10 is removed.

Arm 48 includes an angled aperture 54 having an inlet formed in the top surface of lever portion 52 and an outlet formed in the bottom surface of lever portion 52. The outlet of aperture 54 is located at a greater pivotal distance from the horizontal pivot axis defined by pin 55 than the inlet of aperture 54.

Device 10 further includes a pivot member 56 pivotally mounted to crutch 12 about a generally horizontal axis. Collar 57 is provided having a cross section and shape for receipt onto extension 18 of crutch 12 for pivotally mounting pivot member 56 to crutch 12. Set screws 58 are threadably received in collar 57 for abutting with extension 18 of crutch 12 for removably attaching collar 57 to crutch 12. In the preferred embodiment, screws 58 also pivotally mount pivot member 56 to crutch 12. It should then be appreciated that pivot member 56 may then also be pivotally mounted to crutch 12 without requiring modification to crutch 12 such as drilling apertures therethrough which could structurally weaken crutch 12 or aesthetically change crutch 12 if device 10 is removed.

In the preferred embodiment, pivot member 56 includes a Y-shaped member 60 and a horizontal, abutment member 62. Member 60 includes a U-shaped member 64 and a leg 66 having a first end connected to the center portion of member 64 but extending in a direction opposite to the free ends of member 64. Member 64 straddles collar 57 and extension 18 of crutch 12 such that the free ends of member 64 are located on opposite sides of collar 57 and crutch 12. Abutment member 62 extends between and is attached to the free ends of member 64 on the opposite side of crutch 12 than leg 66. Screws 58 extend through the legs of U-shaped member 64 and into collar 57 at a location generally intermediate the central portion of member 64 and abutment member 62.

Cable 68 is provided for pivotally relating handle 30, lever arm 48, and pivot member 56. Specifically, cable 68 extends from handle 30, through aperture 54 of lever arm 48 and to pivot member 56. In the preferred embodiment shown, cable 68 is attached to handle 30 and pivot member 56 by clevis or swivels 70 and 72, respectively. Swivels 70 and 72 are generally U-shaped, with cable 68 generally attached to the central portion thereof. A pin 74 extends through the free ends of U-shaped swivels 70 and 72 and through handle 30 and pivot member 56, respectively. Therefore, cable 68 is allowed to swivel or pivot about pins 74 according to the teachings of the present invention utilizing swivels 70 and 72.

Device 10 further includes a gripping, anti-slipping, or non-skid member 76. Member 76, in its most preferred form shown, generally includes a U-shaped portion 78 and first, second, and third spike members 80–82. U-shaped portion 78 then generally includes first and second arms having first ends interconnected to each other by a central portion and having second free ends. Cane 10 is then received in the removed portion defined by the first and second arms and the central portion of portion 78, with the first and second arms being located on opposite sides of rubber tip 24 on the bottom end of extension 18 of cane 12.

Spike members 80–82 are shown in the preferred form as being adjustable, and specifically comprise pin members which are threadably engaged into U-shaped portion 78 having ground engaging, non-slip, gripping, or spiking points on their free ends for engagement with the travel surface. Further included are adjustment nuts 83 located on spikes 80–82 for locking spikes 80–82 in the desired position with respect to portion 78. Therefore, the length that spikes 80–82 extend from portion 78 can be adjusted so that spikes 80–82 engage with the travel surface as desired, even though spikes 80–82 may experience uneven wear patterns. In the preferred embodiment, spikes 80 and 82 are located adjacent the free ends of U-shaped portion 78 whereas spike 81 is located adjacent the central portion of U-shaped portion 78.

A pin 84 is threadably engaged to the central portion of U-shaped portion 78 of grip member 76, and in the preferred embodiment, generally vertically above and in line with spike 81. Pin 84 further includes an abutment member 86 located on its second end. Abutment member 86 can be of various constructions, for example, an encased ball bearing, and is generally operatively attached to pivot member 56 shown in the preferred embodiment as abutting against abutment member 62 of pivot member 56. Abutment member 86 also includes an enlarged abutting portion for abutting with the first end of a spring 88.

Device 10 further includes a member 90 for slideably or movably mounting pin 84 generally parallel to but spaced from crutch 12 and for allowing the rotation of pin 84, with pin 84 then defining a vertical axis. In the preferred embodiment, member 90 includes a cylindrical member 92 having a cross section which is slightly larger than pin 84 for slideably receiving pin 84. Due to its circular cross section, pin 84 is free to rotate within cylindrical member 92. Member 90 further includes a second cylindrical member or collar 94 having a cross section for receipt onto extension 18 of crutch 12. Cylindrical member 94 may be held on extension 18 of crutch 12 by set screws 96 which are threadably received in cylindrical portion 94 and abut with extension 18 of crutch 12. It should then be appreciated that cylindrical portion 94 and thus member 90 may be attached to crutch 12 without requiring modification to crutch 12 such as drilling apertures therethrough which could structurally weaken crutch 12 or aesthetically change crutch 12 if device 10 is removed. Cylindrical member 92 is connected to cylindrical member 94 by connection member 98.

The second end of spring 88 abuts with cylindrical member 92 of member 90. Spring 88 is located between abutment member 86 and member 90 for biasing pin 84 upwardly, and thus biasing grip member 76 in its upward, raised, non-travel surface engaging position.

Figure 5:
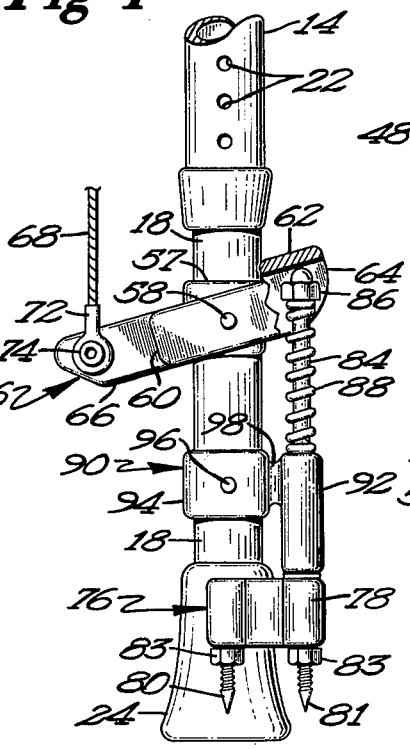
FIG. 5 shows a partial side plan view of the cane and anti-skid device of FIG. 1 in its non-actuated position.

Thus, device 10 has a first, non-actuated position as best seen in FIG. 5 where handle 30 is in its first, normal position as best seen in FIG. 4 and gripping member 76 is located in an upward, non-engaging position and a second, actuated position as best seen in FIG. 2 wherein handle 30 is in its second, engaged position and gripping member 76 is located in a downward, travel surface engaging, gripping position. Due to spring 88, device 10 is biased in its normal, non-actuated position as best seen in FIGS. 4 and 5.

In its non-actuated position as best seen in FIGS. 4 and 5 where gripping member 76 is located upwardly from and does not engage the travel surface, crutch 12 may be utilized in the same manner as crutch 12 not including device 10. However, when a slippery condition is encountered on the travel surface, the user can at that time grasp handle 30 with the fingers of the hand located upon handle 16 to thus pivot handle 30 from its first normal position as best seen in FIG. 4 to its second, engaged position as best seen in FIG. 2. When handle 30 is pivoted from its first position, gripping member 76 is moved downwardly to its engaged position as best seen in FIG. 2 such that spikes 80–82 engage with the travel surface to prevent crutch 12 from slipping on the travel surface. If the travel surface has a continuous slippery condition, handle 30 can be pivoted to its second, fully engaged position such that member 34 under the bias of spring 40 engages with notch 42 of handle 30 for locking handle 30 in its second, fully engaged position as best seen in FIG. 2. Utilizing member 34, it is then not necessary for the user to continually hold handle 30 in its actuated position.

When it is desired to have grip member 76 not engage with the travel surface, it is then only necessary to release member 34 and/or handle 30 such that handle 30 pivots to its first, normal position under the bias of spring 88.

Now that the structure and operation of device 10 according to the teachings of the present invention has been set forth, subtle features and advantages of the present invention can be explained and appreciated. According to the most preferred teachings of the present invention, three spikes 80–82 are provided rather than a single spike. It has been found that a single spike is insufficient and just does not do the job in that the single spike may not contact the travel surface when the cane or crutch is at various angles to the travel surface and due to a build-up of travel residue such as snow or ice. Thus, according to the preferred teachings of the present invention, a plurality of travel surface contacting members are provided, particularly at least two travel surface contacting members are provided, and specifically, according to the most preferred teachings, three travel surface contacting members are provided.

Figure 3:
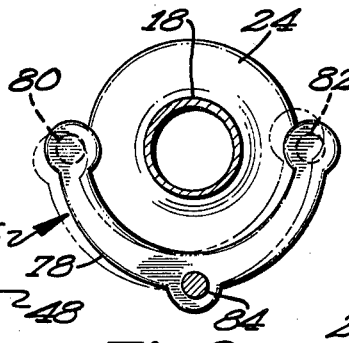
FIG. 3 shows a cross-sectional view of the cane and anti-skid device of FIG. 1 according to section line 3—3 of FIG. 2.

Further, according to the preferred embodiment of the present invention, member 76 is pivotal about a vertical axis defined by pin 84 which is generally parallel to but spaced from crutch 12. This feature and the particular shape of gripping member 76 then obtains several advantages. Specifically, member 76 can pivot or rotate about pin 84 between a first position shown in solid in FIG. 3 where the first arm of portion 78 acts as a first abutment portion and abuts with rubber tip 24 and a second position as shown in phantom in FIG. 3 where the second arm of portion 78 acts as a second abutment portion and abuts with rubber tip 24 located on the bottom end of extension 18 of crutch 12.

This preferred construction of the present invention results in several advantages including the ability to compensate for the angle to which crutch 12 engages the travel surface. Thus, even though crutch 12 is located at an angle to the travel surface, member 76 pivots between the position shown in solid in FIG. 3 and the position shown in phantom in FIG. 3 so that member 76 engages with the travel surface at all times and at least two of spikes 80–82 engage with the travel surface in most cases. Further, the pivotal mounting of member 76 helps to prevent any snow or ice build-up from occurring on spikes 80–82 to avoid jamming of snow or ice on spikes 80 and 82 or between spikes 80–82 and tip 24 of crutch 12. Specifically, when crutch 12 is raised and lowered from the travel surface during walking on the travel surface, spikes 80–82 can engage with the travel surface at different times such that member 76 pivots about pin 84. Furthermore, while crutch 12 maintains its travel surface engagement but the user of crutch 12 moves along the travel surface, the angle of crutch 12 can change such that member 76 pivots about pin 84. Therefore, when member 76 pivots in these situations, any ice or snow collected by spikes 80–82 can be shook and disengaged from spikes 80–82 of member 76.

It should then be appreciated that the preferred location of spike 81 being parallel and in line with the vertical axis defined by pin 84 has several advantages. First, spike 81 assists member 76 in rotating about the vertical axis defined by pin 84 as discussed hereinbefore. Secondly, typically spike 81 contacts the travel surface at all times and thus provides an anchoring type of stability for device 10 especially when at least another spike 80 or 82 also contacts the travel surface.

Lever arm 48 provides a leverage advantage in moving pivot member 56. Specifically, due to the inclined nature of aperture 54, when cable 68 is pulled by handle 30, the cable travel distance and force transfer is increased under leverage principles by arm 48. Further, cable 68 is attached to handles 30 adjacent member 14 and is located closely adjacent to crutch 12 so that cable 68 does not interfere with the actuation of handle 30 by the hand of the user and does not extend a relatively great distance from crutch 12 for catching on objects located along the travel surface. Lever arm 48 then compensates for the resulting cable travel distance and force transfer disadvantage of this cable positioning and allows for this advantageous positioning of cable 68.

The preferred construction of pivot member 56 as shown and described provides several advantages including having an upward actuating direction such that handle 30 can be easily and naturally actuated when desired but presents negligible interference with the crutch in its non-actuated position. Further, pivot member 56 provides advantageous lever type force transfer.

Now that the basic teachings of the present invention have been explained, many extensions and variations will be obvious to one having ordinary skill in the art. For example, although crutch 12 as shown and described in the present application has particular application to the anti-skid device of the preferred embodiment of the teachings of the present invention, the teachings of the present invention can be applied to other types and constructions of canes, crutches, and the like.

Thus, since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. Anti-skid device for a cane, crutch, or the like having a bottom end and a hand hold member, comprising, in combination: a non-skid member; means for movably mounting the non-skid member between a first, raised non-engaged position and a second, lowered surface engaging position and allowing the non-skid member to rotate about a vertical axis generally parallel to but spaced from the cane, with the non-skid member having a removed portion for partially surrounding the lower portion of the cane and defining a first abutment portion and a second abutment portion located on opposite sides of the lower end portion of the cane; means formed on the non-skid member for contacting the surface in a non-skid manner, with the non-skid member being rotatable about the vertical axis between a first position wherein the first abutment portion abuts with a side of the lower end portion of the cane and a second position wherein the second abutment portion abuts with the opposite side of the lower end portion of the cane to insure that the surface contacting means engages with the surface even though the cane is at an angle to the surface and to aid in knocking off any surface residue such as snow or ice from the non-skid member; means for biasing the non-skid member in one of the first or second raised or lowered positions; and means for moving the non-skid member against the bias of the biasing means to the other of its first and second raised or lowered positions.

2. The anti-skid device of claim 1 wherein the non-skid member moving means comprises, in combination: a pivot member pivotally attached to the cane about a generally horizontal axis; and a pin having a first end attached to the non-skid member and a second end operatively attached to the pivot member.

3. The anti-skid device of claim 2 wherein the biasing means biases the non-skid member to its first, raised position and wherein the pivot member has a first end and a second end, with the horizontal pivot axis of the pivot member located intermediate the first and second ends of the pivot member, with the pin abutting the first end of the pivot member.

4. The anti-skid device of claim 3 further comprising, in combination: a handle pivotally mounted to the cane adjacent the hand hold member between a first, normal position and a second, engaged position; and means for pivotally interrelating the handle and the second end of the pivot member.

5. The anti-skid device of claim 4 wherein the pivotally interrelating means comprises a cable attached to the handle and the second end of the pivot member.

6. The anti-skid device of claim 4 or 5 further comprising, in combination: means for holding the handle in its second, engaged position comprising a hook member pivotally mounted to the cane for engaging with and releasably holding the handle in its second, engaged position.

7. The anti-skid device of claim 5 further comprising, in combination: a lever arm pivotally attached about a horizontal pivot axis to the cane; with the lever arm including an aperture for receiving the cable, with the aperture being inclined and having an inlet and an outlet, with the outlet being spaced at a greater pivotal length from the pivot axis of the lever arm than the inlet to provide a leverage type cable travel distance advantage.

8. The anti-skid device of claim 4 further comprising, in combination: first and second collars having cross sections which are complementary to and for receipt on the cane; set screws threadably received in the collars for abutting with the cane without requiring modification of the cane such as the drilling of apertures for locking the collars on the cane, with the handle being pivotally attached to the first collar and with the pivot member being pivotally attached to the second collar.

9. The anti-skid device of claim 3 wherein the pivot member comprises, in combination: a Y-shaped member, and an abutment member, with the Y-shaped member including a U-shaped portion having first and second arms and a leg, with the first and second arms being located on opposite sides of the cane, with the horizontal axis of the pivot member extending between the first and second arms at a location intermediate their length, and with the abutment member being located between the first and second arms adjacent their free ends, with the second end of the pin abutting with the abutment member of the pivot member.

10. The anti-skid device of claim 2 wherein the movably mounting and rotation allowing means comprises, in combination: a collar having a cross section which is complementary to and for receipt on the cane; means for locking the collar unto the cane without requiring modification of the cane such as the drilling of apertures through the cane; and a cylindrical portion having a cross section which is complementary to and for receipt of the pin, with the pin having a circular cross section, and with the cylindrical portion being attached to the collar.

11. The anti-skid device of claim 1 wherein the non-skid member is generally U-shaped and includes first and second arms and a central portion, with the first arm being the first abutment portion and the second arm being the second abutment portion.

12. The anti-skid device of claim 11 wherein the means formed on the non-skid member for contacting the surface in a non-skid manner comprises, in combination: first, second, and third spike members threadably mounted into the non-skid member, with the first spike member being located on the first arm of the non-skid member, with the second spike member being located on the second arm of the non-skid member, and with the third spike member being located on the central portion of the non-skid member and parallel to and in line with the vertical axis.

13. The anti-skid device of claim 1 wherein the means formed on the non-skid member for contacting the surface in a non-skid manner comprises, in combination: a first spike located on the first abutment portion of the non-skid member; a second spike located on the second abutment portion of the non-skid member; and a third spike located on the non-skid member generally parallel to and in line with the vertical axis.

* * * * *